US005558585A

United States Patent [19]

Nolan, Jr.

[11] Patent Number: 5,558,585

[45] Date of Patent: Sep. 24, 1996

[54] DEVICE FOR DETECTING HEAD MOVEMENT

[75] Inventor: James F. Nolan, Jr., Tucson, Ariz.

[73] Assignee: Muscle Memory, Inc., Tucson, Ariz.

[21] Appl. No.: 349,805

[22] Filed: Dec. 6, 1994

[51] Int. Cl.[6] ..... A63B 69/36

[52] U.S. Cl. ..... 473/211; 473/207; 473/208; 473/209; 473/266; 473/274

[58] Field of Search ..... 273/187.2, 183.1, 273/35 R, 26 C, 26 R, 438, 32 B, 188 B, 190 R, 190 B; 434/247, 252; 128/861, 777, 782; 473/207, 208, 209, 211, 266, 274

[56] References Cited

U.S. PATENT DOCUMENTS

| | | | |
|---|---|---|---|
| 3,596,100 | 7/1971 | Hollick | 250/204 |
| 3,983,948 | 10/1976 | Jeter | 175/45 |
| 4,775,788 | 10/1988 | Harshberger et al. . | |
| 4,819,051 | 4/1989 | Jacobson | 341/13 |
| 5,005,835 | 4/1991 | Huffman | 273/187.2 |
| 5,142,655 | 8/1992 | Drumm | 273/438 |
| 5,203,324 | 4/1993 | Kinkade | 128/861 |
| 5,251,902 | 10/1993 | Federowicz et al. | 273/187.2 |
| 5,338,036 | 8/1994 | Takeuchi et al. | 273/187.2 |
| 5,365,946 | 11/1994 | McMillan | 128/861 |
| 5,372,365 | 12/1994 | McTeigue et al. | 273/187.2 |
| 5,373,857 | 12/1994 | Travers et al. | 128/782 |
| 5,373,858 | 12/1994 | Rose et al. | 128/782 |
| 5,428,846 | 7/1995 | Socci et al. | 434/247 |

FOREIGN PATENT DOCUMENTS

| | | | |
|---|---|---|---|
| 2551966 | 3/1985 | France | 128/782 |

*Primary Examiner*—Jessica J. Harrison
*Assistant Examiner*—James Schaaf
*Attorney, Agent, or Firm*—Ladas & Parry

[57] ABSTRACT

A device for detecting head movement of an individual during an activity of the individual is provided. The device includes a weighted wheel for establishing a reference with respect to an initial position of the individual's head, and a first angular encoder and second angular encoder for detecting angular movement of the head with respect to the reference. The detected head movement is processed by a controller and the output is provided by a display and a speaker.

28 Claims, 7 Drawing Sheets

DEVICE FOR DETECTING HEAD MOVEMENT

TECHNICAL FIELD

The present invention relates to a device for detecting head movement of an athlete and more particularly to a device for providing head motion information to an athlete.

BACKGROUND ART

In golf, as in other sports, it is desirable that the golfer be able to repeat the ideal swing in order to achieve superior results. Likewise, in baseball the batter desires to repeat the ideal swing, or a prior successful swing in order to achieve optimum results when hitting the ball.

Similarly, in target practice for archery or shooting, it is desirable to provide an ideal head position in order to obtain repeatable success.

There have been various prior art devices which assist an athlete in this regard. U.S. Pat. No. 3,860,246 discloses a device for aiding a golf player in addressing the ball and maintaining a stance during the backstroke and forward stroke. The device includes a mouthpiece with a plumb-bob weighted body suspended therefrom via a flexible cord. During the backstroke and forward stroke of the golf club, the user can immediately visually notice movement of the user's head by movement of the weighted body.

U.S. Pat. Nos. 4,869,509 and 5,108,104 disclose a mercury switch for detecting when the head of the golfer is aligned within a certain orientation. The devices are positioned at the golfer's head.

U.S. Pat. No. 4,502,305 discloses a golfer's head motion sensor having a piezoceramic bender element a cantilevered position to a plate wherein vertical and side-to-side head movement of the golfer is detected and produces signals in electrical leads attached to opposite sides of the piezoceramic bender element. The electrical signals are processed and provide an indication to the golfer of movement acceleration. The motion sensor is worn upon a golfer's cap.

Certain of the prior art devices are cumbersome and expensive to manufacture. In addition, the motion information provided to the user is crude and somewhat inaccurate as well as limited in terms of the one-dimensional indication of the movement of the head.

SUMMARY OF THE INVENTION

In accordance with the present invention, a device for detecting head movement of an athlete is provided which avoids the prior art problems.

It is an object of the present invention to provide an individual with motion feedback in order to improve the performance of the individual.

It is a further object of the present invention to provide more detailed and accurate motion information.

It is a further object of the present invention to provide a device which is relatively inexpensive to manufacture, rugged and lightweight.

The present invention therefore provides a device for detecting head movement comprising a means for establishing a reference with respect to an initial position of the user's head, and means for detecting angular movement of the user's head with respect to the reference.

In a preferred embodiment, the present invention provides an indication of the vibration, head angle, head rotation, distance traveled throughout the activity, and acceleration.

It is a further feature of the present invention in the preferred embodiment to measure/derive several motion related parameters throughout the activity, to provide such information to the user during the activity and to have such information available after the activity.

It is a further feature of the present invention in the preferred embodiment to allow the user to define the limits of the detected motion.

It is a further feature of the present invention in the preferred embodiment to provide a device which stores detailed information for a particular activity for the purpose of indicating to the user when the particular activity is being successfully repeated.

It is a further feature of the present invention in the preferred embodiment to provide a device which includes a mouthpiece for gripping by the user's teeth.

DETAILED DESCRIPTION OF PREFERRED EMBODIMENT

There are several motion relation inputs that need to measured and/or derived. One of the primary measurements is the "stillness of the head". In golf, it is important to hold the head perfectly still prior to hitting a ball. Thus the head should be moving very little prior to the action. The motion of the head should remain fixed after the ball is hit, at least for a short period of time. Each athlete may want a given range of movement or to know how much they moved and how they moved during a particular action. If an athlete has determined that there is an optimum head angle for his stance, the present invention is capable of providing the information to the athlete.

Motion can be divided up into the general areas of acceleration, velocity, distance, angular acceleration, angular velocity and "vibration". "Vibration" is loosely defined herein as a random motion without any specific direction. It will have a general frequency and amplitude characteristic.

In a person who is breathing and whose heart is functioning, there will always be some random motion, hence, there must be some threshold below which an athlete cannot reduce their "vibrational motion". This threshold should be adjustable for each individual.

There is an acceleration when something is started from rest and a deceleration when it is brought back to rest. The velocity of the object can be determined by integrating the acceleration over time. The distance traveled during the time period can be determined by integrating the velocity over the same period of time. However, each of these terms is made up of three vectors, one in the X, one in the Y, and one in the Z direction. This would require three accelerometers to acquire the data, and then the data must be processed to give the correct information.

There are currently accelerometers that are being manufactured using microelectronic processing that could be integrated into such a system. However, the cost would be rather high. However, the present invention teaches that with some basic assumptions, it is possible to derive the information in a simpler manner.

Figure 1:
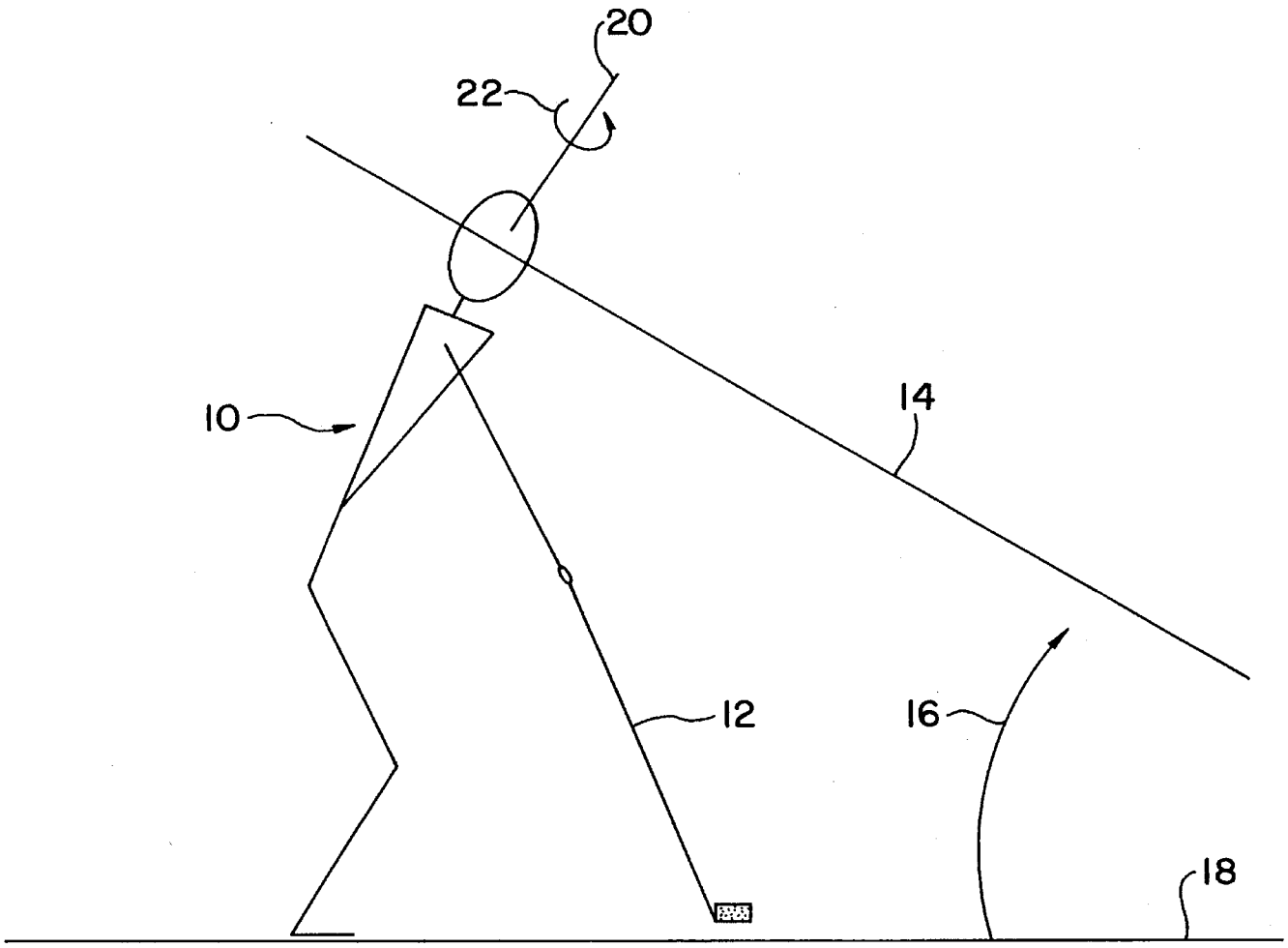
FIG. 1 is a drawing of a golfer and shows the two angles which are measured in accordance with the present invention.

FIG. 1 depicts an individual 10 with a golf club 12 addressing a ball (not shown) prior to the individual 10 swinging the club 12. Line 14 depicts the axis extending forward from the individual's head and which forms an angle 16 with the plane 18 which is horizontal and is tangent with a point (not shown) below the individual 10. The angle 16 represents the head angle of the individual 10 with respect to the plane 18.

FIG. 1 also shows the longitudinal axis 20 which extends upward from the head of the individual 10. Angle 22 represents the rotational angle of the head about the axis 20.

The head is at the angle 16 with the horizontal plane 18 of the earth, and as a reasonable approximation, the head will rotate about the axis 20 of the head. This assumption is only good during the initial swing, but it is the initial part of the swing that is of interest. The rotation angle 22 is measured from the initial position to some position a short time period later, such as 30 milliseconds. Head motion would cause the angle 16 to vary and thus indicate "vibrational motion". Combining the head angle 16 and head rotational angle 22 arrives at a system which meets the needs herein. Positive and negative variations in either angle would be read as random motion or vibration. That is, the head is not at rest.

Figure 2:
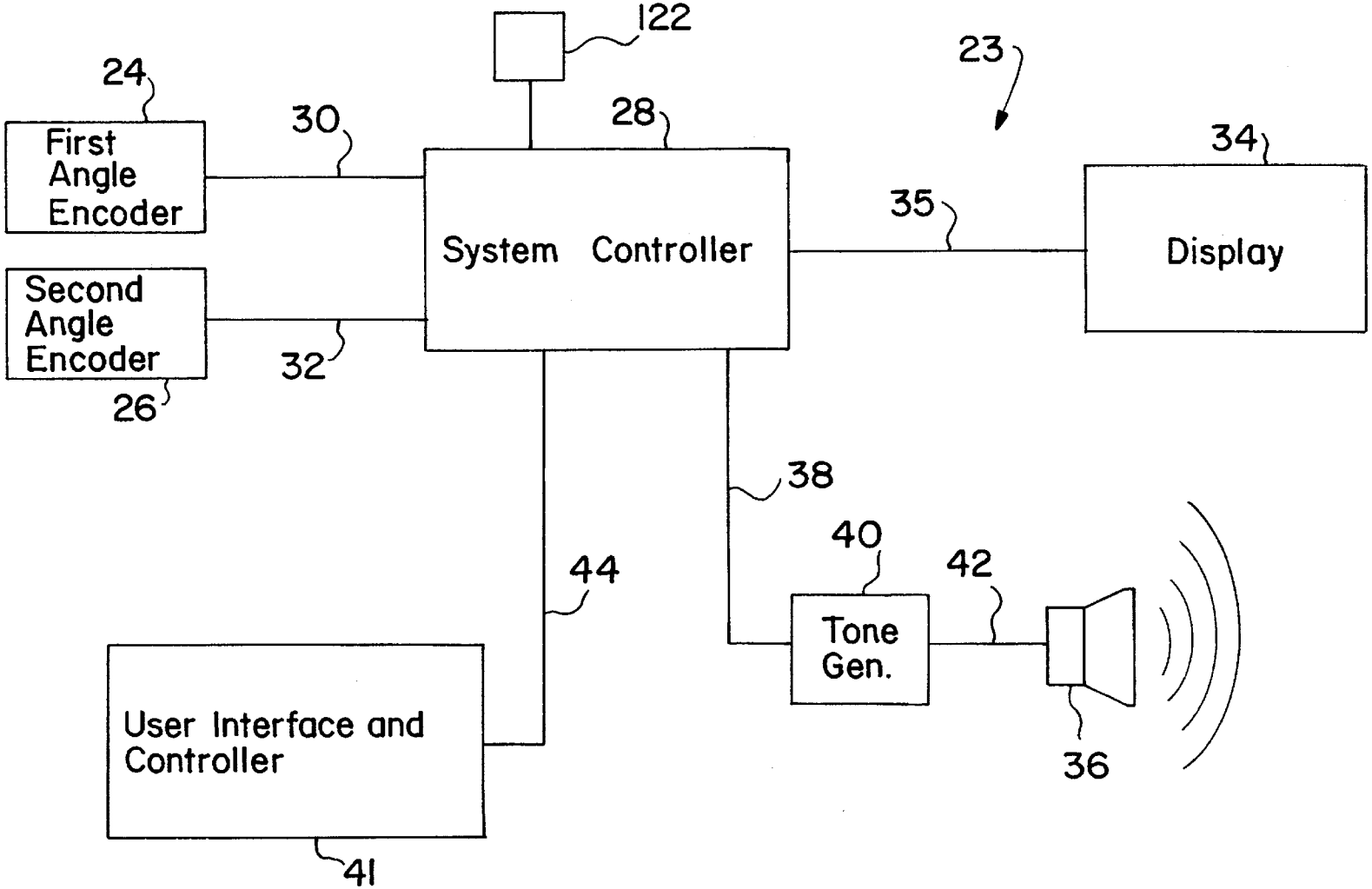
FIG. 2 depicts a block diagram of the device of the present invention.

FIG. 2 shows a block diagram of the device 23 of the present invention. A first angle encoder 24 is shown which measures the angle 16 between the line 14 extending forward from the head and the horizontal plane 18. A second angle encoder 26 is shown which measures the head rotation angle 22. The first angle encoder 24 develops an output signal which is coupled to a system controller 28 via line 30. The second angle encoder 26 develops an output signal which is coupled to the system controller 28 via line 32.

The system controller 28 processes the information received from the first and second angle encoders 24, 26 and provides the processed motion information to the user via the display 34 via line 35 and also to the loud speaker 36 via line 38, tone generator 40 and line 42. A user interface and control 41 is coupled to the system controller 28 via line 44.

Figure 3B:
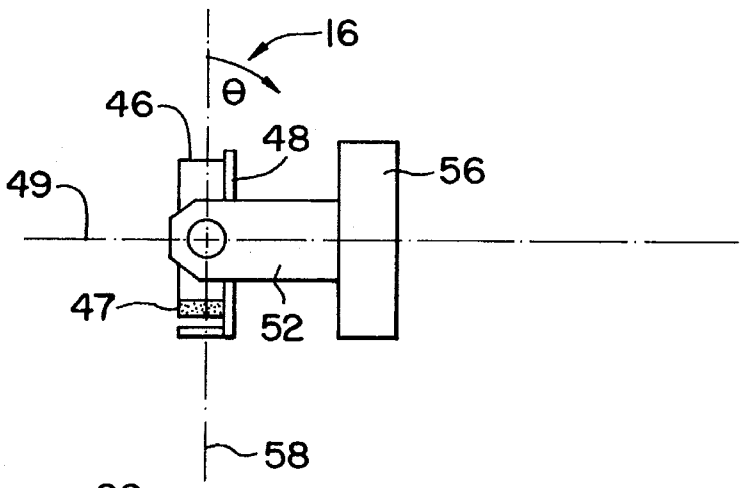
FIG. 3B is a view taking along line 3B—3B of FIG. 3A.
Figure 3A:
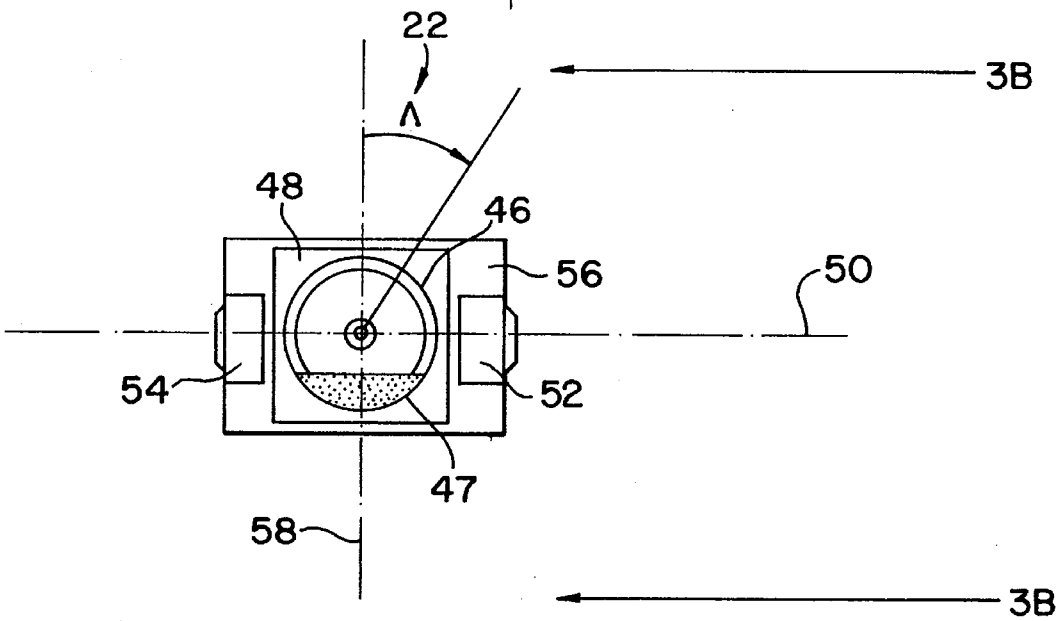
FIG. 3A is a plan view showing the manner in which the weighted wheel of the present invention is supported.

FIGS. 3A, 3B disclose a weighted wheel 46 which includes a weighted area 47. The wheel 46 is used as a pendulum to establish the horizontal plane 18. The wheel 46 is rotatably secured to a platform 48 so as to be free to rotate about a first horizontal orthogonal axis 49. The platform 48 is rotatably secured to a first arm 52 and a second arm 54 which extend from a base 56 so that the platform 48 is rotatable about a second horizontal orthogonal axis 50. In the preferred embodiment, the device 23 of the present invention is held in place by the user's mouth. In this manner, the head motion of the user causes the base 56 and platform 48 to rotate about the respective orthogonal axis with respect to the weighted wheel 46 which maintains its position due to gravitational forces exerted on the weighted wheel 46. The weighted wheel 46 thereby defines a reference for measuring the angular movement of the base 56 and platform 48 which correspond to the head angle 16 and head rotation angle 22, respectively.

In order to measure the head angle 16, the first arm 52 of the base 56 includes the first angle encoder 24. The second arm 54 includes the second angle encoder 26 so as to measure the head rotation angle 22.

Line 59 depicts an axis extending through the plane of the wheel 46 at an initial position or reference from which the head angle 16 can be measured.

Figure 4A:
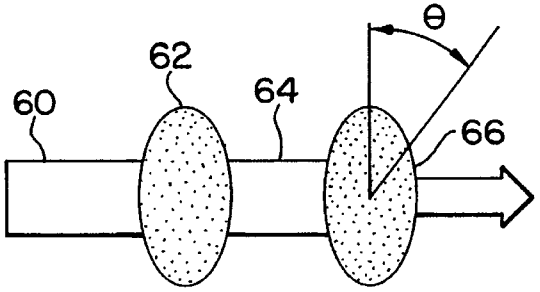
FIG. 4A depicts the fixed and rotating polarizing filters used for measuring one of the angles shown in FIG. 1.
Figure 4B:
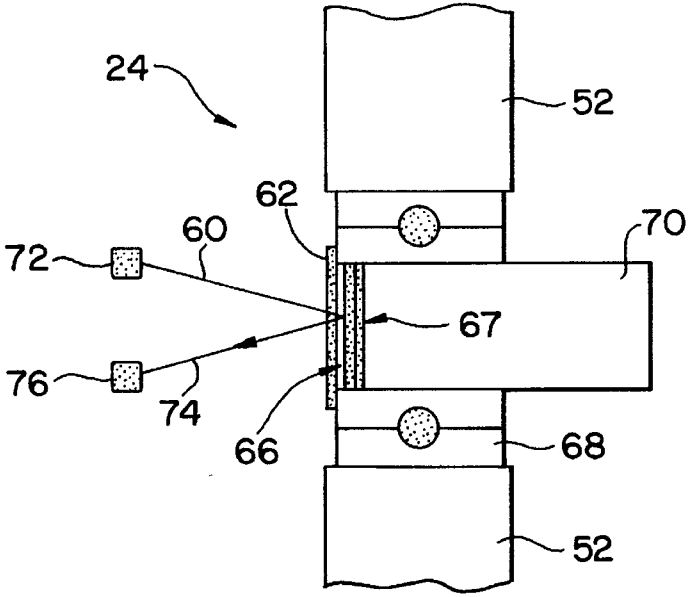
FIG. 4B shows the manner in which the fixed and rotating polarizing filters are mounted in relation to the weighted wheel shown in FIGS. 3A and 3B.

The first angle encoder 24 and second angle encoder 26 can be either optical encoders or magnetic encoders. FIGS. 4A and 4B disclose the first angle encoder 24 in the form of an optical encoder. The first angle encoder 24 shown in FIGS. 4A, 4B makes use of polarized light to measure the angle of rotation of the platform 48 about the first arm 52 of the base 56. As can be seen from FIG. 4A, a beam of light 60 is projected onto the fixed or first filter 62 which produces a polarized beam of light 64 in a single plane. The polarized beam of light 64 is projected onto a rotating or second filter 66. If the rotating filter 66 is aligned in the same plane as the polarized beam of light 64, the polarized beam of light 64 will pass through the rotating filter 66. However, by rotating the second filter 66 with respect to the first filter 62, the polarized beam of light 64 is attenuated. The attenuation is proportional to the angle of rotation. The attenuation factor can be as great as $1\times10^4$. When an angle of 90° is reached, the first and second filters 62, 66 are crossed and the polarized beam of light 64 can no longer pass through the rotating filter 66.

As seen from FIG. 4B, the fixed filter 62 is secured to the bearing 68 of the first arm 52 and the rotating filter 66 is mounted on a mirror 67 which is secured to a first shaft 70 extending within the horizontal axis 50. One of the critical requirements for this design is that there be almost no friction in the bearings. The smaller the frictional forces, the smaller the total system can be, which in turn, will make the system more comfortable for the user. A light emitting diode (LED) 72 is used as the source for the beam of light 60. The polarized beam of light 64 passes through the rotating filter 66 and is reflected back (assuming there is not 100% attenuation) through the fixed filter 62. The reflected polarized beam of light 74 is detected with a first photodetector 76.

One of the main functions of the first angle encoder 24 is the detection of head motion and vibration. The first angle encoder 24 will see the slight head motion and vibration about some given angle as a rapid variation around the average head angle 16. The slight variations in the first encoder angle 24 will be seen as variations in the light intensity at the photodetector 76.

Figure 5:
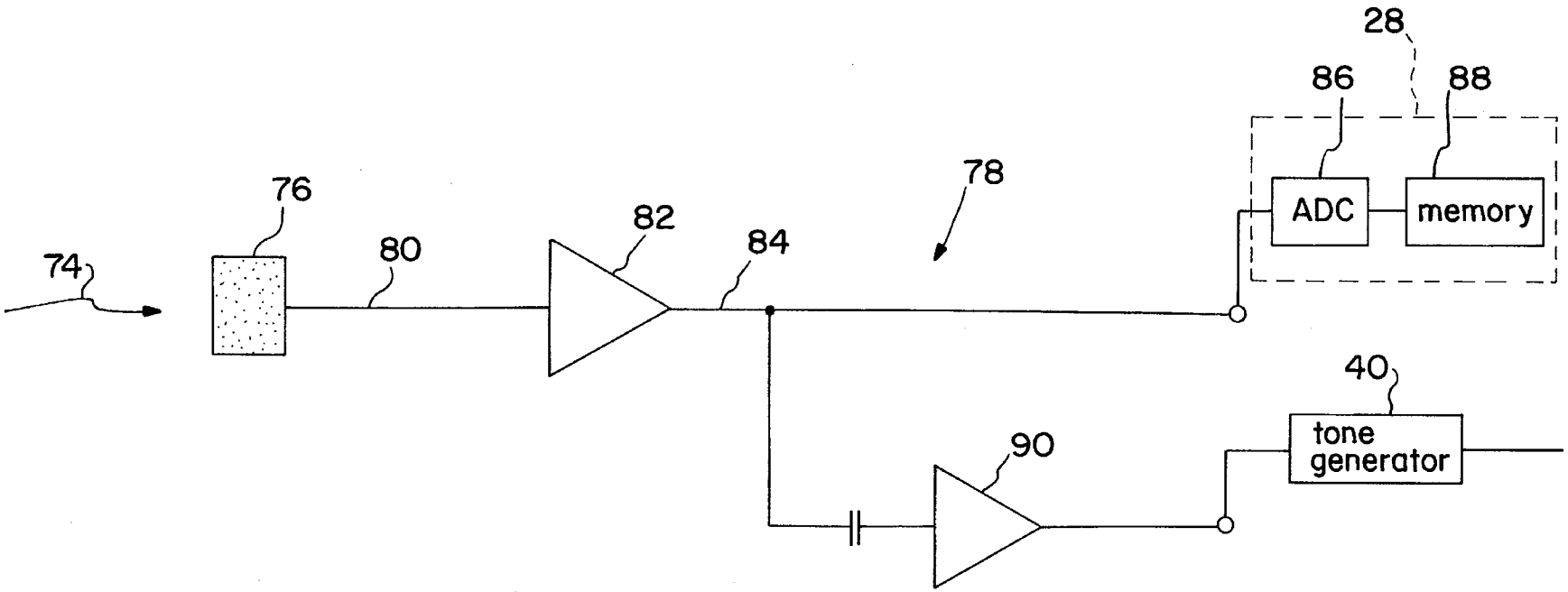
FIG. 5 depicts the second detection circuit for the signal which is developed by use of the fixed and rotating polarizing filters.

FIG. 5 depicts the first detector circuit 78 which includes the photodetector 76 which detects the reflected beam of light 74. The amplitude of the detected signal 80 is a function of the intensity of the reflected beam of light 74 which depends on the angle of the rotation.

The detected signal 80 is amplified by the amplifier 82. The amplified signal 84 consists of an alternating current (AC) riding on top of a direct current (DC) signal that represents the average angle. The greater the AC signal, the greater the variations in the head angle 16.

The DC portion of the amplified signal 84 is read by an analog-to-digital converter (ADC) and stored in the memory 88. The ADC 86 and memory 88 form part of the controller 28. The AC portion of the signal is coupled to the tone generator 40 via an AC amplifier 90 and capacitor 91. The output of the tone generator 40 varies with the amplitude of the AC signal input. An audible tone from the speaker 36 indicates the variations in the head angle 16. Both intensity and frequency could be used as variables. When the variations are reduced to below a given set level, the tone would stop and the user would know that the right conditions were present. The level limits could be entered by the user via the user interface 41.

The vertical angle, or head rotation angle 22, is determined by the relative angle between the platform 48 and the weighted wheel 46. The second angle encoder 26 makes use of Moire'-Fringes to detect the variations in the head rotation angle 22. The initial angle is determined when the head is still and the angle variations are at a minimum.

Figure 6:
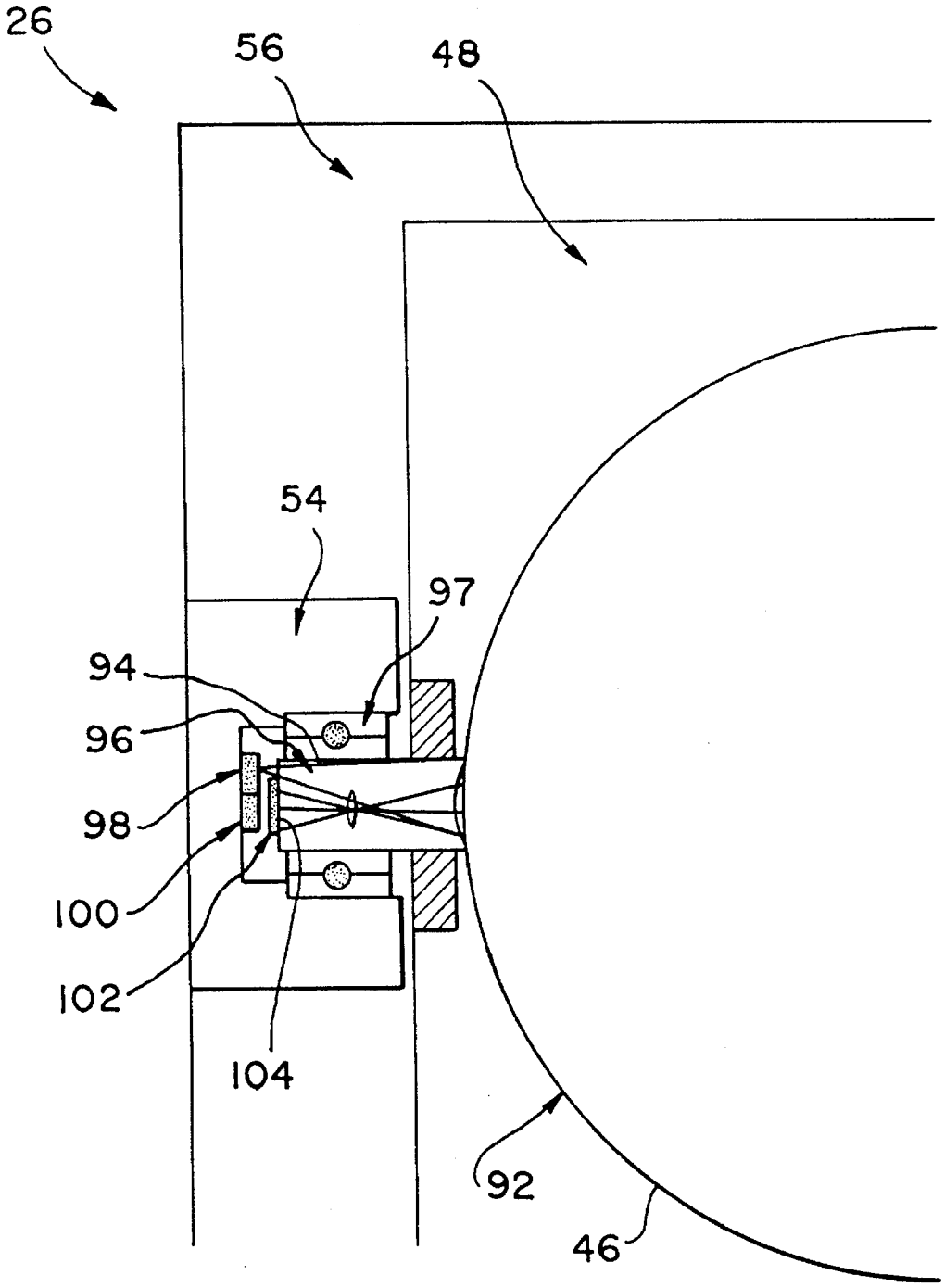
FIG. 6 is a cross section showing the arrangement for measuring the other angle shown in FIG. 1.

Moire'-Fringes are formed when two periodic sets of lines are crossed at a very slight angle. The resulting pattern is a set of dark and light regions that move as a result of a slight motion between the two periodic arrays. The Moire'-Fringes can be used to magnify the motion between the two periodic arrays by a factor of 10 to over 1000. The configuration of the second angle encoder 26 is shown in FIG. 6.

The outer surface of the weighted wheel 46 contains a first series of parallel lines 92 which are also parallel to the center axis of the wheel 46. The lines and spaces therebetween are on the order of 0.001". The second shaft 96 provides support for the platform 48 and extends within the horizontal axis 50. The shaft 96 must be optically clear or hollow in order for the beam of light 94 to pass through. The second shaft 96 is attached to the rear platform 48. The shaft 96 is journaled in the bearing 97 held by the second arm 54.

A second LED 98 is used as a light source for the second angle encoder 26. A second photodetector 100 is placed behind an encoder plate 102 which consists of a transparent plate such as glass or plastic and has a small second series of lines 104 identical to the ones on the circumference of the weighted wheel 46. The width of the lines 104 and the spaces between the lines 104 are normally equal. The lines 104 on the encoder plate 102 are rotated a small number of degrees from being parallel with the lines 92 on the wheel 46. The Moire'-Fringes will move across the front surface of the second photodetector 100 producing a second detector signal 106 which rises and falls with the corresponding light and dark fringe areas. If one were to rotate the wheel 46, a series of pulses would be produced at the output of the second photodetector 100.

Figure 7:
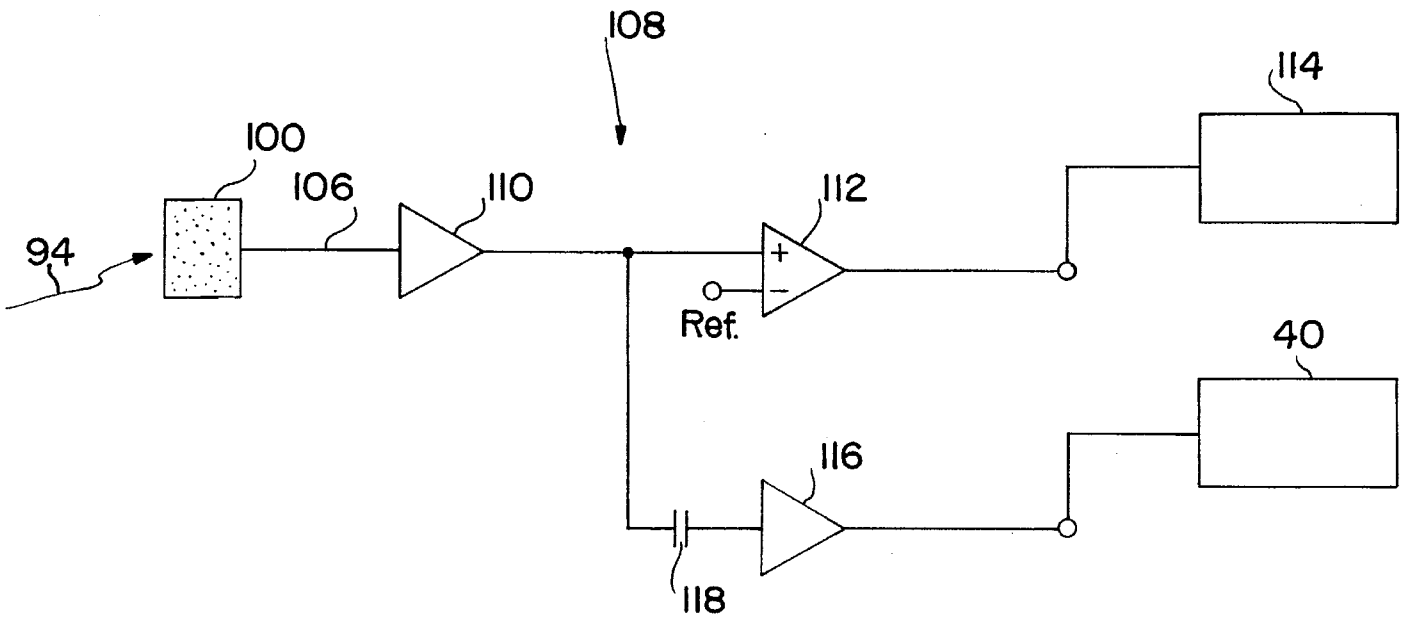
FIG. 7 depicts the electrical circuit for the signal which is obtained by the arrangement of FIG. 6.

FIG. 7 depicts the second detector circuit 108 which includes the second photodetector 100. The pulsed second detector signal 106 is amplified by amplifier 110 and then coupled to a comparator 112. The comparator 112 converts the pulse train into a logic level signal. The total head rotation angle 22 is proportional to the number of fringe pulses counted by the counter 114 which is part of the system controller 28. By AC coupling the pulses to an AC amplifier 116 through a capacitor 118, the variations or vibrations in the head rotation angle 22 can be monitored. The impedance of a capacitor 118 is frequency dependent; hence the signal to the AC amplifier 116 can be a function of the rate in which the pulses are sent. The greater the vibration, the higher the frequency and the greater the AC signal output.

The output of the AC amplifier 116 is coupled to the tone generator 40 as was done with the first angle encoder 24 and treated in a corresponding manner.

As noted above, the device 23 of the present invention is held by the user's mouth. Device 23 includes a mouthpiece 120 which is clutched by the user's teeth. The mouthpiece 120 is detachable with each golfer having his or her own mouthpiece 120.

Figure 8:
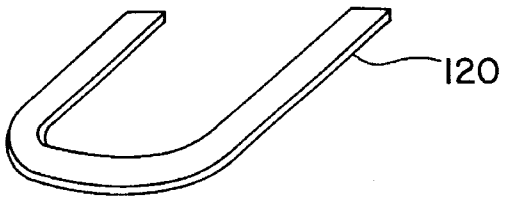
FIG. 8 is a representation of a mouthpiece used with the device of the present invention.

The material used for the mouthpiece 120 can be selected from one of the already approved dental plastics used to make dental impressions. The starting piece could be on the order of 1/16 inches thick. The new mouthpiece could be pressed between the teeth leaving a permanent impression. Some heat treatment might be needed to permanently set the impressions. A "U" shaped mouthpiece 120 is shown in FIG. 8.

The device 23 can detect "vibrational motion" just prior to the ball being hit. The motion can be indicated by a sound which is proportional to the magnitude of the vibration. The indication can be by intensity of sound as well as by the frequency of the sound. It is also possible to separate the two degrees of vibration by using different tones.

The initial position of the system is arbitrary. All of the measurements can be made from the starting position of the golfer's head each time the ball is to be hit. It is possible than an initial angle that is to be repeated could be entered into the system so that the head can be brought to the desired angle before the ball is hit.

The device 23 can include a reset switch 122 which would insure that the data was not lost before it could be read by the user 10. To activate the device 23, a pressure reset switch 122 could be built into the mouth piece 125 so that a slight pressure could be applied by the user 10 to initiate the operating sequence; however, the system controller 28 can continually monitor the motion of the device 23. If the reset switch 122 has been pushed, the controller 28 could then look for the correct conditions such as the position of the head and the relative motion of the head. When the head is in the right position and still, the device 23 can start monitoring the motion and also indicate to the user 10 that the device 23 is ready, such as with an audible tone.

The device 23 is adjustable from 0 inches to 4 inches in increments of 1/8 of an inch to establish a tempo and rhythm for golf. A setting of 0 inches can be used for putting, with adjustments through the wedges, longirons, midirons, T shots, as head movement is different for each stroke. In baseball, a different head angle, set position and movement may be required when attempting to hit a single, home run or a bunt. The present invention is capable of providing information which can assist the batter to achieve optimum performance.

I claim:

1. A device for detecting head movement of an individual during an activity of the individual, comprising:

a base;

means for establishing a reference with respect to an initial position of the individual's head, the reference establishing means includes, a platform having a shaft pivotally secured to the base, and a weighted wheel rotatably secured to the platform and free to rotate about its axis, the platform free to pivot about an axis extending through the plane of the wheel and the shaft; and means for detecting angular movement of the head with respect to the reference, the detecting means includes a first angular encoder positioned at the head of the golfer to measure a head angle between the reference and an axis extending forward from the head, the reference extending in a horizontal plane, and a second angular encoder positioned at the head of the golfer to measure an angular rotation of the head along the longitudinal axis of the head, the first angular encoder having an output signal representing the angle between the reference and the base, and the second angular encoder having an output signal representing the angle of rotation of the wheel about its axis.

2. The device of claim 1, further comprising means for generating a tone having an input coupled to the first and second angular encoder, and a loud speaker coupled to the tone generating means.

3. The device of claim 1, further comprising:

means for computing having an input coupled to the output signals of the first and second encoders, and an output, the computing means having an output to produce data indicating vibration, head angle, head rotation, angular distance and angular acceleration; and display means coupled to the output of the computing means for displaying the calculated information.

4. The device of claim 3, wherein the encoders are magnetic encoders.

5. The device of claim 3, wherein the base includes a first and a second arm extending outwardly supporting the platform, the first encoder is an optical encoder secured to the first arm, and the second encoder is an optical encoder secured to the second arm.

6. The device of claim 5, wherein the first encoder includes:

a mirror secured in fixed relation with the platform;

a rotating polarizing filter positioned over the mirror and adapted to rotate with the mirror and platform about the axis extending through the plane of the wheel;

a fixed polarizing filter secured to the first arm and aligned with the rotating filter and mirror;

a first light source projecting a beam of light through the fixed filter, the rotating filter, and then reflected off the mirror; and a first photodetector positioned to detect the amplitude of the reflected beam of light and produce an output proportional to the angle of the rotating filter with respect to the fixed filter, the output having a direct current component and alternating current component.

7. The device of claim 6, wherein the light source is a light emitting diode.

8. The device in claim 7, further comprising a memory for storing the head angle.

9. The device of claim 6, further comprising:

an analog-to-digital converter having an input coupled to the output of the photodetector, and an output;

a controller having an input coupled to the output of the analog-to-digital converter, and an output indicating the head angle; and a means for displaying the head angle.

10. The device of claim 6, further comprising:

a tone generator having an input coupled to the output of the photodetector; and a loud speaker coupled to the output of the tone generator, whereby the output of the tone generator varies with the amplitude of the AC component of the photodetector output.

11. The device of claim 10, wherein the tone generator includes means for producing an output which varies in intensity.

12. The device of claim 10, wherein the tone connector includes means for producing an output which varies in frequency.

13. The device of claim 5, wherein the second angle encoder includes:

indicia on the wheel forming a series of parallel lines that are also parallel to the wheel axis;

a second light source secured in fixed relation to the second arm projects a beam of light onto the indicia from which the beam of light is reflected;

an encoder plate is secured to one end of the shaft and is aligned with the beam of light reflected from the indicia, the encoder plate having parallel lines identical to the lines on the wheel, the encoder plate rotated slightly from a position parallel to the lines on the wheel; and a second photodetector positioned behind the encoder plate and aligned with the reflected beam of light from the second light source, whereby the second photodetector produces a series of pulses as the wheel is rotated.

14. The device of claim 13, further comprising a counter coupled to the output of the second photodetector to detect the number of pulses, whereby the total angle of rotation of the wheel is proportional to the number of pulses.

15. The device of claim 13, wherein the second light source is a light emitting diode.

16. The device of claim 13, wherein the lines and spaces therebetween are approximately 0.001 inches in width.

17. The device of claim 13, wherein the shaft supports the platform and allows light to pass through, the shaft is secured to the platform and one end is aligned with the indicia, the second light source projects the beam of light through the shaft and onto the indicia.

18. The device of claim 17, wherein the shaft is made of optically clear material.

19. The device of claim 17, wherein the shaft is hollow.

20. The device of claim 13, wherein the output of the second detector is coupled to the input of the tone generator, where the output tone of the speaker is proportional to the quantitative sum of the amplitude detected by the first photodetector and the number of pulses produced by the second photodetector.

21. The device of claim 13, wherein the output tone of the speaker varies in intensity proportional to the quantitative sum of the amplitude detected by the first photodetector and the number of pulses produced by the second photodetector.

22. The device of claim 13, wherein the output tone varies in frequency proportional to the quantitative sum of the amplitude detected by the first photodetector and the number of pulses produced by the second photodetector.

23. The device of claim 13, wherein a user interface and control is coupled to the computing means.

24. The device of claim 23, wherein the user interface and control is adapted to set initial conditions and limits.

25. The device of claim 24, further comprising means for storing in the memory the measured head angle and head rotation angle during a first activity, and means for providing an indication when the head position equals the stored head angle and head rotation angle during a second activity.

26. The device of claim 13, further comprising a mouthpiece for supporting the device from the mouth.

27. The device of claim 26, wherein the mouthpiece is removably attached.

28. The device of claim 26, wherein the mouthpiece is molded to a particular individual's teeth.

* * * * *